US006292207B1

(12) United States Patent
Sogabe

(10) Patent No.: US 6,292,207 B1
(45) Date of Patent: Sep. 18, 2001

(54) LINE THERMAL HEAD LETTER PRINTING METHOD

(75) Inventor: Masuo Sogabe, Tsurugashima (JP)

(73) Assignee: Daisey Machinery Co., Ltd., Tsurugashima (JP)

( * ) Notice: Subject to any disclaimer, the term of this patent is extended or adjusted under 35 U.S.C. 154(b) by 0 days.

(21) Appl. No.: 09/634,642

(22) Filed: Aug. 8, 2000

(51) Int. Cl.[7] ..... B41J 17/08; B41J 33/36; B41J 33/52

(52) U.S. Cl. ..... 347/217

(58) Field of Search ..... 347/217; 400/224.1, 400/224.2, 225, 232, 234, 231

(56) References Cited

U.S. PATENT DOCUMENTS

| | | | | |
|---|---|---|---|---|
| 4,104,965 | | 8/1978 | Abe . | |
| 5,593,238 | | 1/1997 | Fox et al. . | |
| 5,647,679 | * | 7/1997 | Green et al. | 347/217 |
| 5,908,251 | | 6/1999 | Buckby . | |
| 5,993,092 | * | 11/1999 | Palmer | 400/234 |

FOREIGN PATENT DOCUMENTS

| | | | | |
|---|---|---|---|---|
| 0 493 942 | | 7/1992 | (EP) . | |
| 0 802 117 | | 10/1997 | (EP) . | |
| 9-156144 | * | 6/1997 | (JP) | 347/217 |
| 62-263080 | * | 11/1997 | (JP) | 400/234 |
| WO 99/34983 | | 7/1999 | (WO) . | |

* cited by examiner

*Primary Examiner*—Huan Tran
(74) *Attorney, Agent, or Firm*—Oblon, Spivak, McClelland, Maier & Neustadt, P.C.

(57) ABSTRACT

Line thermal head letter printing method is improved to feed ribbon tape synchronously with transfer velocity of print object sheet from immediately after start of printing so as to obtain high quality letter printing. Ribbon tape master roll (6) is driven by stepping motor (18) so as to feed necessary amount of ribbon tape (4). Ribbon tape winding roll (8) is driven via friction transmission so as to wind the ribbon tape (4) at velocity higher than that of transferring print object sheet (2). There occurs no loosening of ribbon tape hot release portion at tip of line thermal head (10) and high quality letter printing is obtained.

2 Claims, 2 Drawing Sheets

Mechanism for removing ribbon tape loosening by giving always tape winding directional rotation even in either directional motor rotation Mechanism for removing ribbon tape loosening by giving always tape winding directional rotation even in either directional motor rotation

LINE THERMAL HEAD LETTER PRINTING METHOD

BACKGROUND OF THE INVENTION

1. Field of the Invention

The present invention relates to a line thermal head letter printing method of a synchronous type for making a letter printing by feeding a hot release type thermal transfer ribbon tape following a transfer velocity of a print object sheet and especially relates to a line thermal head letter printing method in which feeding and winding of the ribbon tape are improved.

2. Description of the Prior Art

In recent years, there are often cases where letters and marks, such as date of manufacture, tastable time period and series number of manufacture, are printed on a packaging material differently for each of objects to be printed. In such cases, the printing is often done by feeding a hot release type thermal transfer ribbon tape following a transfer velocity of a sheet as an object to be printed, such as a packaging material film, (herein referred to as "a print object sheet") and by supplying a line thermal head, such as that called a corner edge type or an end face type, which is pressed against the ribbon tape, with electricity.

In case the printing is done on the print object sheet, which is being transferred with a high velocity, by the line thermal head using the hot release type thermal transfer ribbon tape, when a portion to be printed of the print object sheet comes, it is necessary that the ribbon tape is wound to be fed synchronously with the velocity of the print object sheet. For this purpose, that is, in order to wind the ribbon tape to feed it synchronously with the velocity of the print object sheet in time for start of the printing, a rise time is needed.

Because of such rise time, there is necessarily caused a delay in the start of the winding of the ribbon tape. Despite such delay in the start of the winding of the ribbon tape, as the ribbon tape, which is in contact with the print object sheet, is fed upon start of the printing, there may be caused a loosening of the ribbon tape hot release portion at a tip of the head in the initial stage of the printing immediately after the start of the printing, which often results in the problem that there is caused a place where no printing is done at a head portion of the printing or the printing is out of order because of no good hot release, and it has been found that this problem arises in the case where the printing is done on the print object sheet which is being transferred at a high velocity of 10 inch/second or more.

As mentioned above, in the conventional letter printing method for printing letters by using a line thermal head supplied with electricity and a hot release type thermal transfer ribbon tape, there is a problem that a printing of a desired quality may not necessarily be done at the starting time of the printing.

SUMMARY OF THE INVENTION

In view of the problem in the prior art, it is an object of the present invention to provide a line thermal head letter printing method by which a hot release type thermal transfer ribbon tape may be fed synchronously with a transfer velocity of a print object sheet from immediately after a start of printing so that a high quality printing may be obtained.

In order to attain the mentioned object in the letter printing method for printing letters on the print object sheet, which is being transferred, by using the line thermal head and the hot release type thermal transfer ribbon tape, the present invention provides a line thermal head letter printing method comprising steps of: feeding a necessary amount of the ribbon tape at a velocity synchronized with a transfer velocity of the print object sheet by using a stepping motor, and winding the ribbon tape via a friction transmission by a power rotating at a velocity higher than that of the print object sheet being transferred.

By employing the mentioned letter printing method, winding of the ribbon tape is done while the ribbon tape is being stretched via the friction transmission by the power rotating at the velocity higher than that of the transferring print object sheet, thus the ribbon tape is so wound that a tension acts on the ribbon tape continuously, there occurs no loosening of the ribbon tape hot release portion at a tip of the head and the hot release of the ribbon tape takes place always in a good condition.

While a ribbon tape winding side wants to so stretch the ribbon tape at the velocity higher than that of the transferring print object sheet, there is an effect of a torque of the stepping motor provided on a ribbon tape feeding side and the ribbon tape is in no case fed at a velocity higher than that fed by a drive mechanism using the stepping motor.

Also, in the letter printing method according to the present invention, if both of the feeding and the winding of the ribbon tape are done by a roll drive and a feeding amount of the ribbon tape is detected by a rotary encoder, then it will be preferable as an inked face of the ribbon tape may not be damaged.

Thus, according to the letter printing method of the present invention, a clear and high quality printing can be done also on the print object sheet which is being transferred at a velocity higher than 10 inch/second or more with which there has been a problem.

DESCRIPTION OF THE PREFERRED EMBODIMENTS

Figure 1:
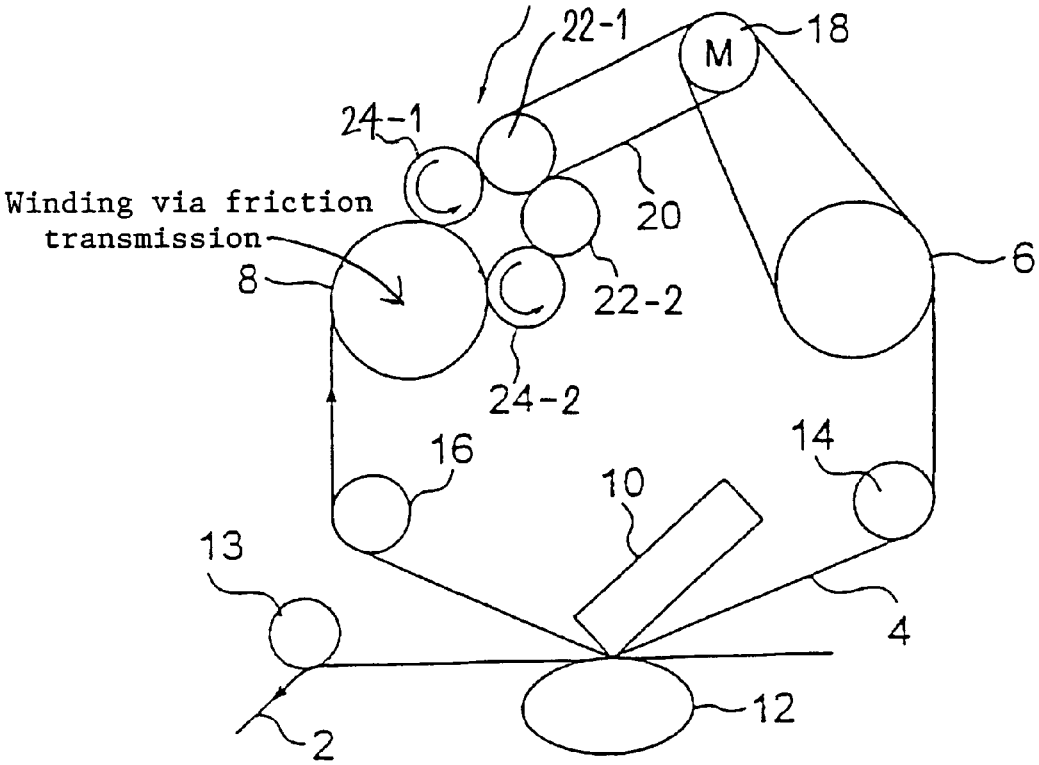
FIG. 1 is an explanatory constructional view of a construction example of a letter printing device for working a letter printing method according to the present invention.

Herebelow, a letter printing method according to the present invention will be described concretely using an embodiment illustrating this method. FIG. 1 shows one example of a letter printing device for working the letter printing method of the present invention. In FIG. 1, numeral 2 designates a print object sheet which is being transferred to a direction shown by arrow. Numeral 4 designates a thermal transfer ribbon tape, which is fed from a ribbon tape master roll 6 to be wound around a ribbon tape winding roll 8 while being disposed on the print object sheet 2 on the way. The ribbon tape winding roll 8 is rotated by a power transmitted from a power transmission mechanism, described later, via a friction transmission by a sliding clutch.

Numeral 10 designates a line thermal head and numeral 12 designates a platen unit comprising a plate or roller. The platen unit 12 is disposed under the line thermal head 10, thereby the print object sheet 2 and the thermal transfer ribbon tape 4 are put between the line thermal head 10 and the platen unit 12 so that a letter printing may be done on the print object sheet 2. Numeral 13 designates a sheet velocity detecting encoder for detecting a transfer velocity of the print object sheet 2.

Numeral 14 designates a rotary encoder and guide roller, which detects a feeding velocity of the ribbon tape and at the same time guides a feeding of the ribbon tape. Numeral 16 designates a guide roller, which guides the feeding of the ribbon tape. Numeral 18 designates a stepping motor, which rotates the ribbon tape master roll 6 to feed the ribbon tape in the amount needed for the printing.

According to FIG. 1, a drive force of the stepping motor 18 is transmitted to the ribbon tape winding roll 8 via a belt 20, transmission rolls 22-1, 22-2 and one-way clutch gears 24-1, 24-2 so as to drive the ribbon tape winding roll 8 rotationally.

In FIG. 1, the power transmission mechanism comprises the belt 20, the transmission rollers 22-1, 22-2 and the one-way clutch gears 24-1, 24-2 and is constructed such that the ribbon tape winding roll 8 is rotated always in a tape winding direction even if the stepping motor 18 rotates in either direction so as to remove a loosening of the ribbon tape 4.

Also, a transmission ratio of the drive force which is transmitted from the stepping motor 18 to the ribbon tape winding roll 8 is so set that a stretching force acts always on the ribbon tape 4 as a diameter of the ribbon tape winding roll 8 changes.

In the letter printing device constructed as mentioned above, the ribbon tape master roll 6 is driven by the stepping motor 18 so that the ribbon tape 4 is fed at a velocity equal to the transfer velocity of the print object sheet 2 and at the same time the power rotating at a velocity higher than the transfer velocity of the print object sheet 2 is transmitted to the ribbon tape winding roll 8 via the friction transmission by the sliding clutch so that the ribbon tape 4 is wound around the ribbon tape winding roll 8.

Thus, a tension acts always on the ribbon tape 4 so that there occurs no loosening of the ribbon tape hot release portion at the tip of the line thermal head 10 and the ribbon tape 4 may be wound around the ribbon tape winding roll 8 always with a good condition of the hot release. Hence, a clear letter printing can be done using the hot release type ribbon tape.

As mentioned above, while the ribbon tape 4 receives a stretching force acting toward the ribbon tape winding roll 8, as there is acting the torque of the stepping motor 18 on the ribbon tape 4, the ribbon tape 4 is in no case fed more than needed beyond the velocity fed by the drive mechanism using the stepping motor 18.

Also, when the ribbon tape 4 is to stand still, as a stationary torque can be obtained by using the stepping motor 18, the ribbon tape 4 is in no case dragged by a contact resistance or an electrostatic force with the print object sheet 2.

Also, in the illustrated letter printing device, as the feeding amount of the ribbon tape 4 is monitored by the rotary encoder and guide roller 14, an amount of the ribbon tape 4 fed during the time of acceleration or deceleration in the process to follow the velocity of the print object sheet 2 can be fed back to be rewound around the ribbon tape master roll 6 only by rotating the stepping motor 18 reversely, hence a consumption of the ribbon tape 4 can be saved.

Further, in the present letter printing device, as the feeding and the winding of the ribbon tape 4 are done both by the roll drive, even when the roll of the ribbon tape is made with the inked face being on the outer side, the inked face of the ribbon tape is in no case damaged by a load while moving on a transfer path. Also, as there is no press feed mechanism using a drive roller, there are greatly reduced a dirt of a feed roller and a falling of sticking matters and an excellent print quality can be maintained.

Furthermore, in the range of the feeding velocity of the ribbon tape of 10 inch/second or less, even if the relation of the feeding and the winding in the present system of the roll drive is reversed so as to drive the winding roll, there is acting no load on the inked face and an excellent print quality can be maintained.

Figure 2:
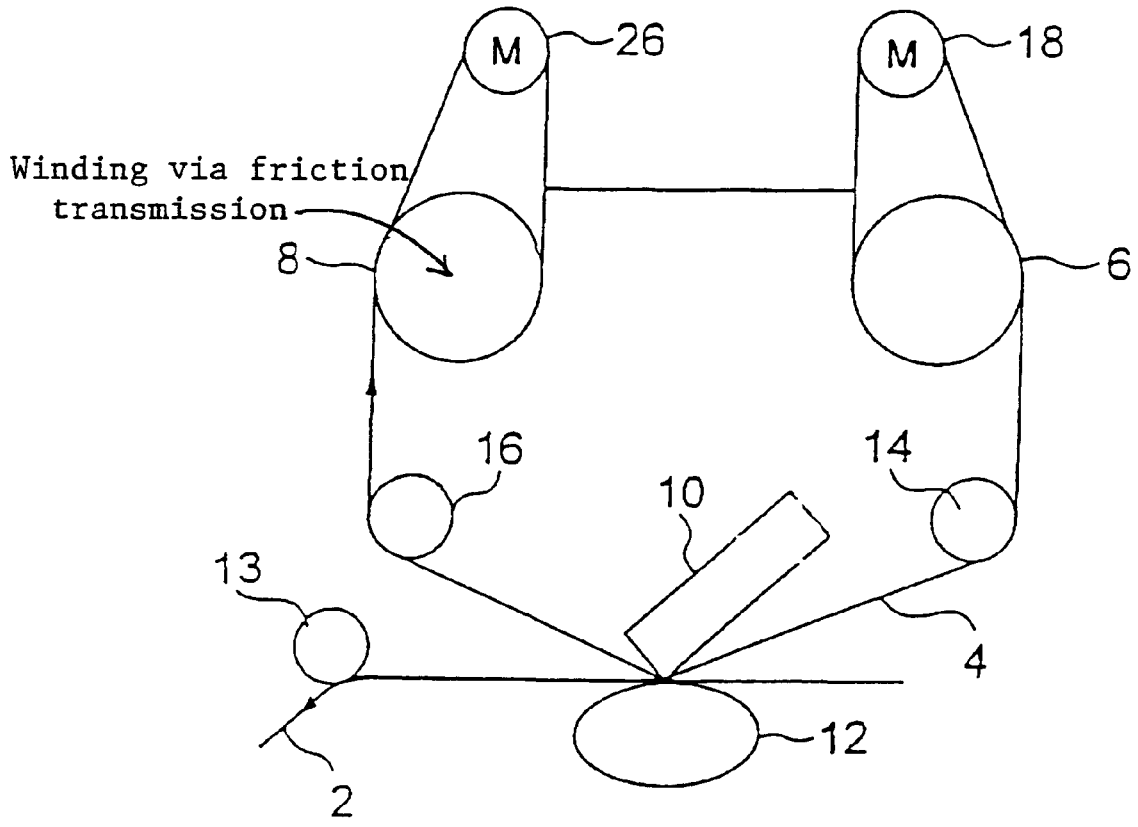
FIG. 2 is an explanatory constructional view of a partial variation example of the construction of the letter printing device of FIG. 1.

In the letter printing device as described above, while the ribbon tape master roll 6 and the ribbon tape winding roll 8 are driven by the single stepping motor 18, the construction may be made such that the ribbon tape master roll 6 and the ribbon tape winding roll 8 are driven separately by two stepping motors 18, 26, as shown in FIG. 2. In this case, the ribbon tape winding roll 8 is driven by the stepping motor 26 via a sliding clutch.

If the drive is so done by the separate drive motors, there is no need of providing a power transmission mechanism comprising a one-way clutch gear and the like as in the device shown in FIG. 1.

According to the letter printing method of the present invention, the necessary amount of the ribbon tape is fed at the velocity synchronized with the transfer velocity of the print object sheet by using the stepping motor and this ribbon tape is wound via the friction transmission by the power rotating at the velocity higher than that of the transferring print object sheet, thereby the ribbon tape is stretched continuously via the friction transmission by the drive force of the velocity higher than that of the print object sheet so that there occurs no loosening of the ribbon tape hot release portion at the tip of the head and the hot release of the ribbon tape takes place always in a good condition.

Thus, according to the letter printing method of the present invention, a clear and high quality printing can be done also on the print object sheet which is being transferred at the velocity higher than 10 inch/second or more with which there has been a problem.

It is understood that the invention is not limited to the particular construction and arrangement herein illustrated and described but embraces such modified forms thereof as come within the scope of the appended claims.

What is claimed is:

1. A line thermal head letter printing method for printing letters on a print object sheet by using a line thermal head and a hot release type thermal transfer ribbon tape, comprising the steps of:

providing a friction transmission including first transmission of power via a first one-way clutch gear configured to transmit a rotation of a stepping motor via a first transmission roller and second transmission of power via a second one-way clutch gear configured to be rotated by said first transmission roller via a second transmission roller;

feeding a necessary amount of said ribbon tape at a velocity synchronized with a transfer velocity of said print object sheet by using said stepping motor; and winding said ribbon tape via said friction transmission by a power rotating in one direction at a velocity higher than said transfer velocity of said print object sheet being transferred, said first one-way clutch gear transmitting a rotation of said stepping motor via said first transmission roller and said second one-way clutch gear being rotated by said first transmission roller via said second transmission roller for said winding.

2. A line thermal head letter printing method as claimed in claim 1, further comprising:

detecting a feeding amount of said ribbon tape by a rotary encoder;

wherein said feeding and winding steps comprise feeding and rewinding said ribbon tape by a roll drive, respectively.

* * * * *